US005544614A

United States Patent [19]

Cushman

[11] Patent Number: 5,544,614

[45] Date of Patent: Aug. 13, 1996

[54] TRAFFIC BARRICADE

[75] Inventor: Veronica B. Cushman, La Jolla, Calif.

[73] Assignee: VBCO, La Jolla, Calif.

[21] Appl. No.: 208,968

[22] Filed: Mar. 9, 1994

[51] Int. Cl.[6] ..... G09F 15/00; E01F 9/00

[52] U.S. Cl. ..... 116/63 P; 116/28 R; 40/610; 404/6; 404/9

[58] Field of Search ..... 116/63 P, 28 R, 116/30, 63 R, 209, DIG. 16, 63 T; 40/610, 606, 612; 182/165–176, 180–186; 404/6, 8–10; 256/24, 65; 403/348, 83, 85

[56] References Cited

U.S. PATENT DOCUMENTS

| | | | |
|---|---|---|---|
| 830,485 | 9/1906 | Norton | 182/167 |
| 1,235,433 | 7/1917 | Burrowes | 108/125 |
| 2,649,803 | 8/1953 | Andre . | |
| 3,822,668 | 7/1974 | Schradieck et al. . | |
| 3,868,630 | 2/1975 | Lesondak | 116/63 P |
| 3,916,816 | 11/1975 | Fitch . | |
| 3,917,232 | 11/1975 | Lindner | 404/6 |
| 3,949,701 | 4/1976 | Teixeira . | |
| 4,007,919 | 2/1977 | Totten . | |
| 4,026,086 | 5/1977 | Langley . | |
| 4,042,107 | 8/1977 | Kendig | 206/386 |
| 4,050,401 | 9/1977 | Kelly | 116/63 P |
| 4,071,224 | 1/1978 | Gilbert | 116/63 P |
| 4,083,033 | 4/1978 | Kulp et al. . | |
| 4,232,466 | 11/1980 | Mathis | 40/606 |
| 4,298,186 | 11/1981 | Glass . | |
| 4,624,210 | 11/1986 | Glass . | |
| 4,646,807 | 3/1987 | Doublet | 256/24 |
| 4,674,432 | 6/1987 | Schmanski . | |
| 4,681,187 | 7/1987 | Brown | 182/181 |
| 4,859,983 | 8/1989 | Kulp et al. . | |
| 4,943,035 | 7/1990 | Thomson et al. . | |
| 5,003,912 | 4/1991 | Thurston . | |
| 5,009,541 | 4/1991 | Thurston . | |
| 5,046,885 | 9/1991 | Thurston . | |
| 5,123,767 | 6/1992 | Ishikura et al. | 403/348 |

*Primary Examiner*—William A. Cuchlinski, Jr.
*Assistant Examiner*—Andrew Hirshfeld
*Attorney, Agent, or Firm*—Brown, Martin, Haller & McClain

[57] ABSTRACT

A barricade assembly is made up from a plurality of panel units which can be secured together to provide a barricade of adjustable height. Each panel unit has spaced parallel side legs and a planar cross member extending transversely between the legs. A hinge mechanism allows two panel units to be releasably hinged together at their upper ends so that they can be angled relative to one another in a free-standing, open position. Two or more panel units can also be releasably secured together in vertical alignment to adjust the height of the assembly.

23 Claims, 6 Drawing Sheets

TRAFFIC BARRICADE

BACKGROUND OF THE INVENTION

The present invention relates generally to barricades for controlling vehicular and foot traffic by providing a barrier which acts as a visual warning as well as physically obstructing passage to hazardous areas.

Portable traffic barricades are used at road maintenance and construction sites, for example, so as to provide a warning to motorists and allow them to avoid the barricaded area. They are also used in pedestrian areas to provide a warning of construction and other hazards and to indicate an alternative pathway for foot traffic. Traffic barricades are generally of the fixed or collapsible A-frame type. Collapsible traffic barricades typically comprise a pair of panels which are hinged together at their upper ends and which carry reflective strips or signs.

Warning lights may also be mounted on the barricades. Known barricades are typically made out of wood, steel or plastic. The disadvantage of wood and steel barricades is that they are likely to cause significant damage to vehicles which accidentally impact the barricade structure, as well as injury and possible loss of life to occupants of vehicles impacting the barricades, as well as people in the vicinity. The steel legs of such barricades become projectiles on impact, and may hit people in the vicinity, causing significant injuries and damage. They are also relatively heavy and difficult to transport from site to site.

Plastic barricades known in the art are easier to transport and set up. However, they have the disadvantage of being more likely to topple over in high winds, and also being susceptible to damage on impact. Wind gusts can cause the legs of pivoted barricades to move towards one another, thus reducing their stability until eventually they fall over. In order to avoid this problem, plastic barricades have sometimes been ballasted with sand or sand bags.

SUMMARY OF THE INVENTION

It is an object of the present invention to provide a new and improved barricade structure or assembly.

According to the present invention, a barricade assembly is provided which comprises a plurality of panel members, each panel member having a pair of spaced, parallel legs interconnected by at least one planar cross member extending between the legs. A releasable hinge mechanism provides a releasable hinge connection between the upper ends of the legs of a pair of the panel members so as to permit the panel members to pivot between an open, freestanding position at an angle to one another to form two sides of an A-frame stand, and a collapsed position.

Each panel member has a first interlocking mechanism at the upper end of each leg and a second interlocking mechanism at the lower end of each leg for releasable engagement with the first interlocking mechanism at the upper ends of the corresponding legs of another panel member aligned with the legs of the first panel member. This secures the panel members in a vertically stacked, co-planar arrangement. With this arrangement, a first pair of panel members can be secured together in vertical alignment one on top of the other in a co-planar arrangement, and a second pair of panel members can also be secured vertically in the same way, with the uppermost panel member of each pair pivoted at its upper end to the uppermost panel member of the other pair, to form a stand of increased height. In this way, the stand height can be selectively adjusted from one panel on each pivoted side of the stand to two or more panel members on each side of the stand.

In a preferred embodiment of the invention, each leg is of open channel cross-section, having a base wall and upstanding side walls. The channels are preferably also open-ended, at least at the upper end of each leg, and the panel members are designed to be hinged together with the open faces of the channel legs facing inwardly. Preferably, each leg has at least one pair of aligned openings in the side walls at the upper end of the channel, and the upper ends of the channels of a pair of panel members can be mated together so that the side walls are side by side and the openings are all aligned. The hinge mechanism preferably comprises a releasable hinge pin for extending through the aligned openings in each pair of mated legs.

The lower end portion of each leg is preferably enlarged and designed for telescopically receiving the upper end portion of a corresponding leg of another panel member when two panel members are secured together end-to-end in vertical alignment. When two pairs of panel members are stacked in this way and the uppermost panel members of each pair pivoted together, the height of the stand is increased. In a preferred embodiment of the invention, opposing inwardly projecting bosses are provided on the inner faces of the side walls in the lower end portion of each leg, for releasable snap engagement in openings or recesses in the side walls of the channel at the upper end of a mating leg.

Preferably, stop devices are provided for limiting the pivot angle between the panel members and also for resisting collapse of the panel members from the open position. Additionally, each cross member preferably has a compartment on the inner face of the panel member with an open upper end for receiving sand, dirt, gravel, water, or other material into the compartment for increased weight and stability.

The barricade assembly of this invention is inexpensive to manufacture, since the panel members are all identical, and can be molded out of a suitable lightweight and durable plastic material. It is versatile and can be easily adjusted in height according to site requirements. It is durable and is made up of several component parts which can be individually replaced if damaged, reducing expense.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
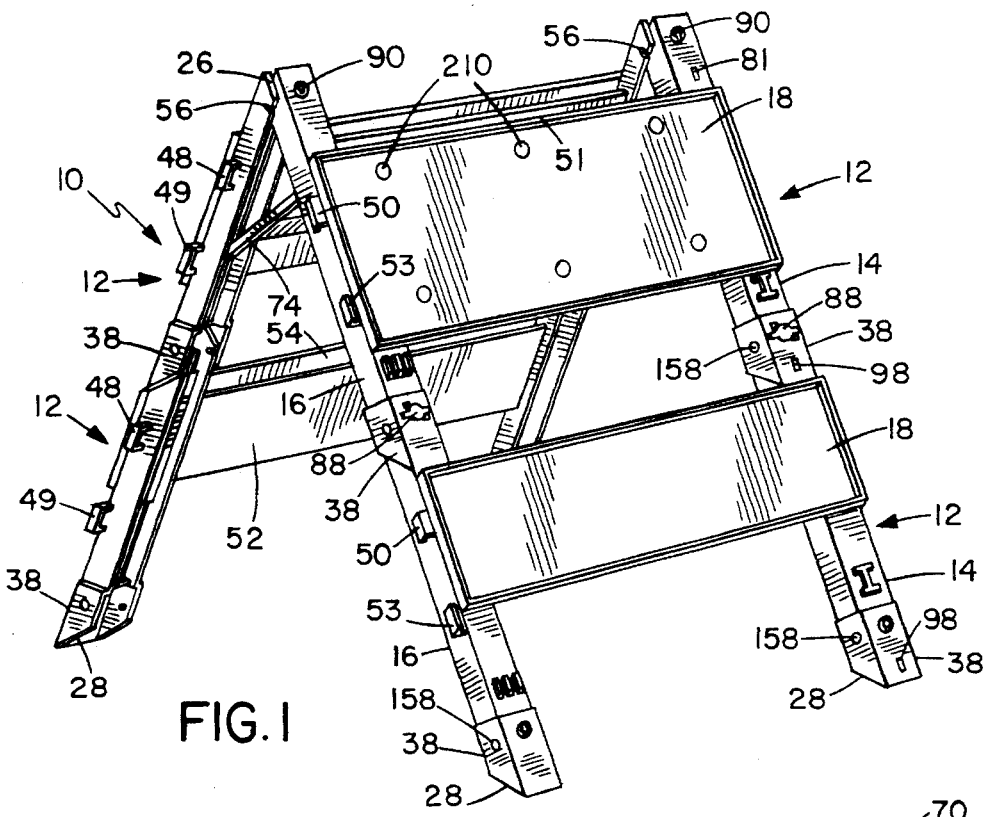
FIG. 1 is a perspective view of a traffic barrier using four panel units according to a first embodiment of the invention.

FIG. 1 of the drawings illustrates a traffic barrier 10 constructed from four panel units 12 according to a first embodiment of the invention. Any desired number of panel units may be assembled together to provide generally A- or V-shaped barriers of various heights, with the uppermost pair of panel units being releasably hinged together, as will be explained in more detail below.

Figures 3, 4, 5, 6, 7, 8, 9, 10:
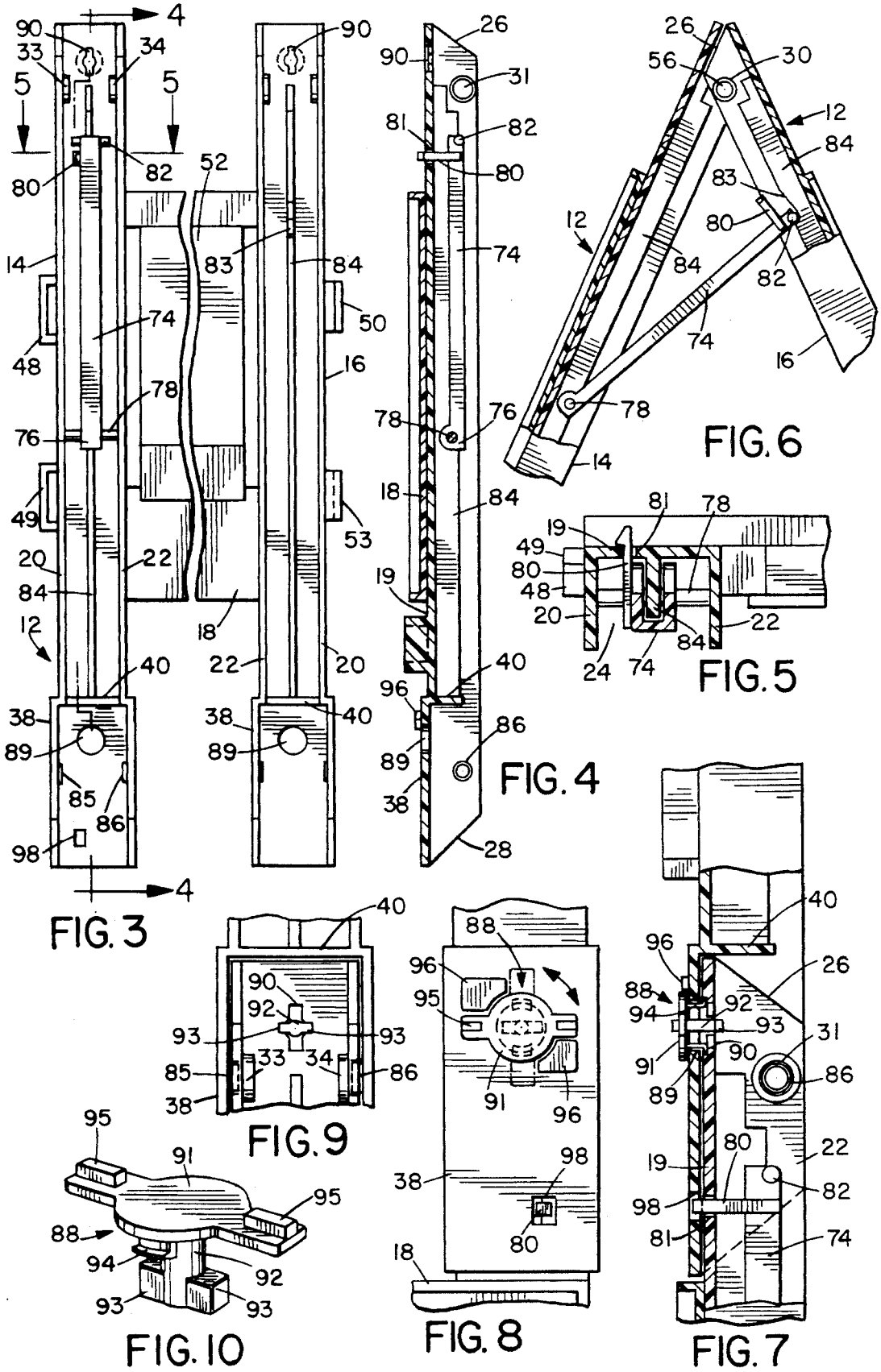
FIG. 3 is an enlarged view taken in the direction of arrow A in FIG. 2 of one unit of the assembly.
FIG. 4 is a sectional view taken on line 4—4 of FIG. 3.
FIG. 5 is a sectional view taken on line 5—5 of FIG. 3.
FIG. 6 is an enlarged side elevation view, partially cut away, of the top portion of the assembly.
FIG. 7 is an enlarged side elevation view, partially cut away, of the central joint circled in FIG. 2.
FIG. 8 is a front elevation view of the connection of FIG. 7, taken from the left hand side of FIG. 7.
FIG. 9 is a rear elevation view of a portion of the connection of FIG. 7 taken from the right hand side of FIG. 7.
FIG. 10 is a perspective view of a latch pin as used in FIGS. 7–9.

The panel units are preferably injection molded from a suitable lightweight, shock resistant plastic material. The plastic material may be polyethylene, preferably at least 10% recycled. FIGS. 3 and 4 illustrate one of the panel units 12 in more detail. As best illustrated in FIGS. 3 and 4, panel unit 12 has a pair of parallel, spaced side legs 14, 16 interconnected by a flat cross member 18 extending between the legs. Each leg 14, 16 is of square or channel-like cross-section, having a base wall 19 and upstanding side walls 20, 22 forming an elongate channel 24. Each channel is open at the upper and lower ends of the legs, with the side walls being inclined to formed angled edges 26, 28, respectively, at their upper and lower ends.

The side walls 20, 22 of each leg have a pair of aligned holes 30, 31 at their upper ends, and the upper ends of the legs are designed to be releasably hinged to the upper ends of the legs of a second, co-operating panel unit via hinge or pivot pin 56, and as illustrated in FIG. 6. Each hole has a raised circular rim 33, 34 surrounding it on the inner face of the respective wall, as illustrated in FIG. 3.

Each leg 14, 16 has an enlarged channel portion 38 at its lower end which is dimensioned for mating engagement with the upper end portion of the channel of a corresponding leg of another panel member. A transverse web 40 extends across the base of the channel at the intersection between the enlarged portion 38 and the remainder of the leg. Upstanding, opposing bosses or protrusions 85, 86 are provided on the inner faces of the side walls in the enlarged portion 38, and bosses 85 and 86 are designed for engagement in the respective holes 30, 31 at the upper end of a corresponding leg of another panel member or unit inserted into the enlarged portion, as best illustrated in FIGS. 7 and 9. This allows two of the panel units to be located together in a vertically aligned, co-planar arrangement. Each leg may have an enlarged protective lip at its lower end for added stability.

The legs are positively secured together by means of a twist lock or latch pin 88, which is illustrated in detail in FIG. 10. Twist lock pin 88 is designed to extend through a circular opening 89 provided in the base wall of enlarged channel portion 38 of each leg and an aligned, key shaped opening 90 provided at the upper end of each leg of a second panel unit inserted into the enlarged channel portions 38. As best illustrated in FIG. 10, the twist lock pin 88 has an enlarged head 91, and a pin shaft 92 extending downwardly from head 91. Shaft 92 has opposing projections 93 at its lower end forming a shape matching that of key opening 90. Thus, the shaped end can be inserted through key opening 90 when in the correct orientation, illustrated in dotted outline in FIG. 8. After insertion, the pin can be rotated into the locked position illustrated in solid lines in FIG. 8 and in FIG. 9, locking the legs together.

A pair of spring-loaded fingers 94 project downwardly from head 91 on each side of shaft 92, as illustrated in FIGS. 7 and 10. These are designed for snap engagement in circular opening 89 so that a twist lock pin can be retained in each of the openings 89 ready for use even when the leg is not secured to any other panel unit. The head 91 also has raised finger grips or abutments 95 for use in urging the head between the locked and unlocked positions. A pair of diametrically opposed stop members 96 are provided on the outer surface of the base of the channel portion 38 on opposite sides of openings 89, as illustrated in FIG. 8. These act as stops to restrict rotation of the twist lock pin to a 90° arc between the locked and unlocked positions, as illustrated by the arrows in FIG. 8, and prevent over-rotation of the pin. This provides a positive indication to the user that the pin is in the fully locked position.

In the embodiment illustrated in FIGS. 1–10, the first leg 14 of each panel member or unit has a pair of offset, vertically oriented eyelet members 48, 49 on its outer face, while the second leg 16 has a pair of oppositely directed hook members 50, 53 on its outer face for fitting into the respective eyelets 48, 49, as best illustrated in FIGS. 1 and 3 to secure two panel members together side-by-side. Because of the offset and oppositely directed hook members, two panel members cannot be easily separated once connected together side-by-side.

The cross member 18 has an outer face comprising a tray having a raised peripheral rim 51. Suitable markings such as reflective tape or signs as are conventionally used on traffic barricades may be applied to the base of the tray, where they will be protected to some extent by raised rim 51. Preferably, panel units are made with cross members 18 of at least two different heights. Two different height cross members are illustrated in FIG. 1, with the uppermost cross member having dimensions of 12 inches by 24 inches and the bottom cross member having dimensions of 8 inches by 24 inches. The cross members may be positioned with the largest on top, as illustrated, or on the bottom, or two of the same height may be used. Panel units will be selected according to the size of signs to be attached. Panel units 18 are provided with spaced holes 210 which may be used for units and bolts to hold traffic signs in place, if desired. Signs may be hung by any suitable means utilizing holes 210.

An upwardly facing compartment 52 having an open upper end 54 may be provided on the rear of cross member 18 and to extend across the width of the cross member. Suitable ballast material such as sand, water, gravel or the like may be poured into the compartment to add to the weight, and thus the stability, of the stand.

Figure 17:
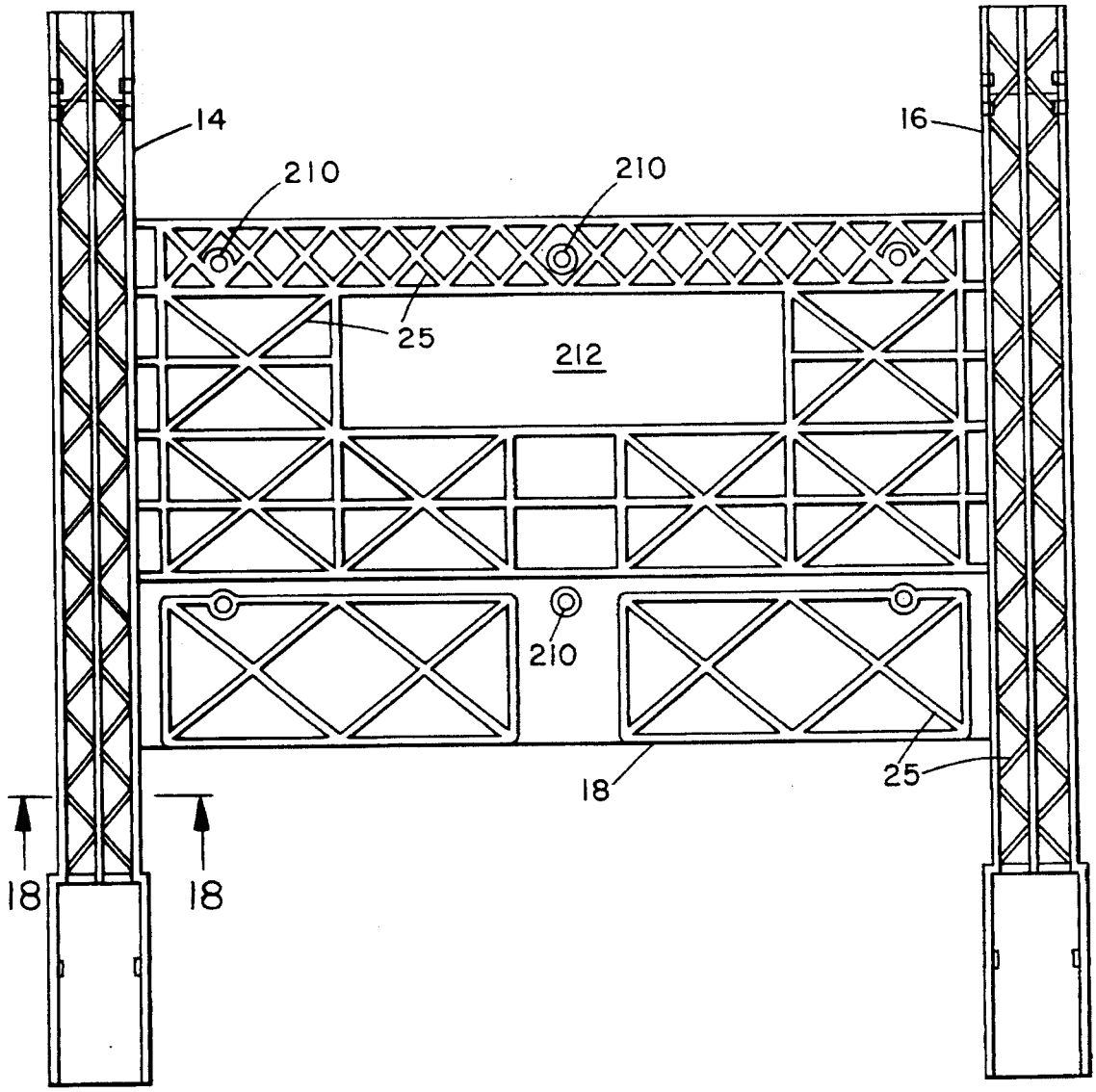
FIG. 17 is a rear view of the structure taken in the direction of arrow A in FIG. 2 showing an optional reinforcing arrangement.
Figure 18:
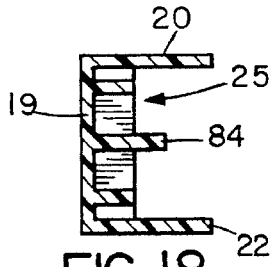
FIG. 18 is a sectional view taken on line 18—18 of FIG. 17.

The panel units are preferably reinforced by webbing or ribbing 25, for example as illustrated in FIGS. 17 and 18 on the rear face of the cross member 18 and in the channels 24 of each leg. In this case, compartment 52 is eliminated. The webbing in each leg includes an upstanding straight central web 84 which is taller than the rest of the webbing. The cross member 18 also has a flat area 212 on its rear face with no ribbing. This may be used for a logo or the like, and preferably has dimensions around 2 inches by 10 inches.

Figure 2:
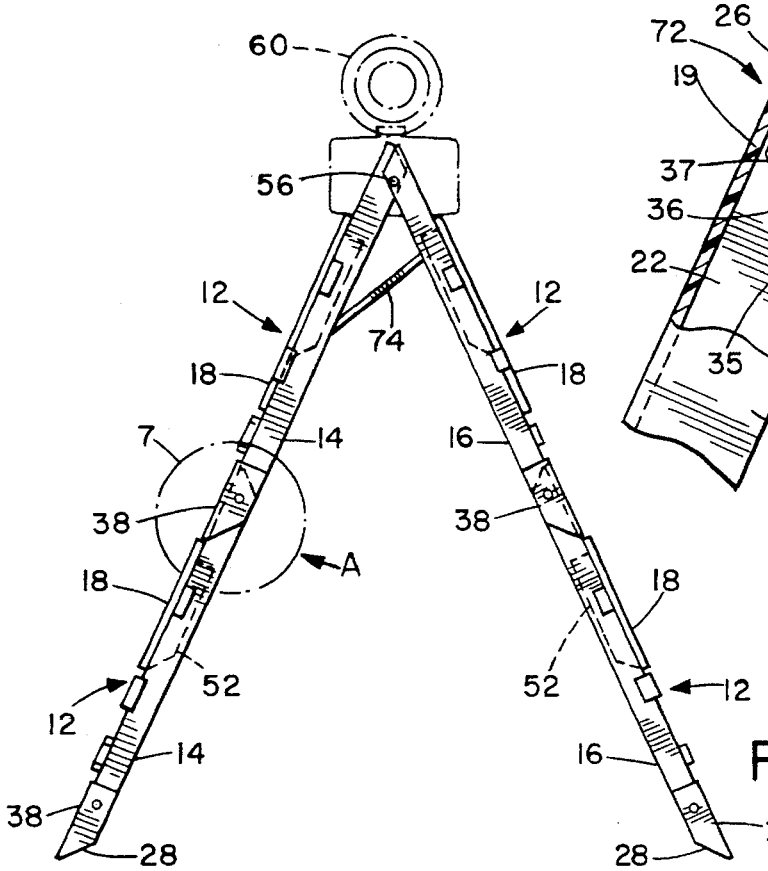
FIG. 2 is a side elevation view of the assembly.

The upper ends of a pair of panel units 12 may be releasably pivoted together by placing the panel units with their inner faces facing one another, and tilting them towards one another so that the channel of first leg 14 of a first panel unit mates at the upper end with the channel of the second leg 16 of a second panel unit, and the second leg 16 of the first panel unit mates with the first leg 14 of the second panel unit. When the channels are mated together as illustrated in FIGS. 1, 2 and 6, the side walls of the channels will be interleaved with the outer side walls 20 of legs 14 and 16 adjacent one another and the inner side walls 22 of the legs 14 and 16 also located adjacent one another. The upper ends of the respective legs are positioned so that the respective pairs of openings 30, 31 in the four channel side walls are all aligned, and a pivot pin 56 is then inserted through the aligned openings, as best illustrated in FIGS. 1 and 6, to releasably hinge the two panel units together. It can be seen in FIG. 6 that the angle of the inclined upper edge 26 of the channel side walls will control the maximum pivot angle of the structure, since the angled end of the channel in one leg will act as a stop against the base wall 19 of the channel in the other leg into which it is inserted.

A lever arm 74 is pivoted at one end 76 to one of the legs 14 of each panel unit via pivot pin 78. The lever arm 74 is retained in the channel 24 via latch finger 80 when not in use. The latch finger 80 is secured to the upper end of arm 74 and extends through an aligned opening 81 in the base wall 19 of the channel in the latched position, as best illustrated in FIG. 5, retaining the lever arm in its retracted position in the channel.

When two panel units 12 are hinged together as in FIG. 6, the latch fingers 80 of the lever arms 74 in the leg 14 of each unit 12 are released, and the lever arms then drop down into the operative position illustrated in FIG. 6, in which the free end 82 of each lever arm engages in a notch 83 provided for that purpose in an upstanding web 84 in the channel 24 of the leg 16 of the opposing panel unit. The lever arm then acts as a stop to resist collapse of the panel units from the open position. It can be pushed up to release the panels when the barricade is to be taken down. The free end 82 of lever arm is of a roller-like configuration, as best illustrated in FIGS. 3 and 6, so that it can slide smoothly into notch 83. The lever arm 74 is itself of channel cross-section, as illustrated in FIG. 5, and engages over upstanding web 84 when retracted, so that it is securely retained in position.

As best illustrated in FIGS. 1, 3 and 8, the enlarged end portion 38 of the leg 14 of each panel unit has an opening 98 in its front face. Opening 98 is positioned to receive the projecting portion of latch finger 80 when two panel units are stacked end-to-end to increase the stand height, as best illustrated in FIGS. 7 and 8. This opening may be used to receive an anchoring stake through the lowermost leg in a stand, for additional stability in high wind situations.

If desired, a signal light 60 may be supported on the aligned upper edges of the two cross members 18 of the pivoted panel units, as illustrated in dotted outline in FIG. 2. A signal light may be necessary to provide sufficient warning of the hazard or barrier at night or under poor light conditions.

When a single pair of the units is pivoted together, it forms a basic barrier of a certain height and width. However, additional panel units can be assembled together with the first pair in order to adjust the height of the barrier as desired. FIGS. 1 and 2 illustrate the attachment of two additional panel units at the lower ends of two pivoted panel units in order to increase the barrier height. In order to double the height of one side of the barrier, the upper ends of the legs 14, 16 of one panel unit are inserted into the enlarged lower end portions 38 of the legs 14, 16 of a second panel unit until the bosses 85, 86 engage in the respective holes 30 and 31, as illustrated in FIGS. 7–9. The latch pins 88 are then inserted and locked, as explained above. The procedure is repeated for the other pivoted half of the barrier, and the uppermost panel units are then pivotally secured together as described above. Additional panel units may be secured vertically to the assembly for increased height, if necessary.

In order to adjust the length of the assembly, pivoted pairs of panel units may be positioned side by side until the desired length is achieved, with the legs 14 of one set of pivoted panel units being alongside the legs 16 of an adjacent set of pivoted panel units. Where hooks 50, 53 and eyelets 48, 49, are provided, hooks 50, 53 on legs 16 can be inserted in eyelets 48, 49 on the legs 14 of the adjacent pivoted panel units, simply by lifting the legs 16 until the hooks can be dropped into eyelets 48, 49. Thus, any number of pivoted panel units can be releasably secured together to form an elongate barrier of a desired length.

Each panel unit 12 can be manufactured simply and inexpensively from three basic injection molded parts, to make leg 14, leg 16, and cross member 18 separately. The three molded parts are then suitably secured together by welding, bolting, adhesive or the like. When the panel units are assembled together into the desired barrier formation, the design of the interlocking formations is such that they will easily snap or break apart on impact, reducing the risk of damage both to the panel units themselves and to the impacting vehicle. The same pieces can then be reassembled or replacement pieces may be used if damage was substantial.

The open-topped sand compartments 52 allow sand or other granular ballast material to be easily poured into or out of the compartments, so that the weight and stability of the barricade units can be readily adjusted as necessary, according to wind conditions and the like, for example. The units can be transported with the compartments completely empty so that they are lightweight and easy to carry.

Figure 14:
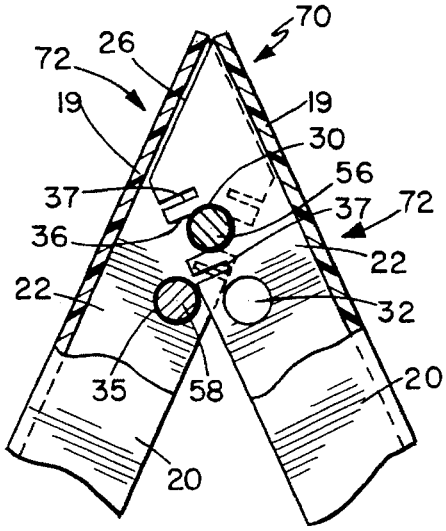
FIG. 14 is a view similar to FIG. 6, showing the alternative hinge connection.
Figure 11:
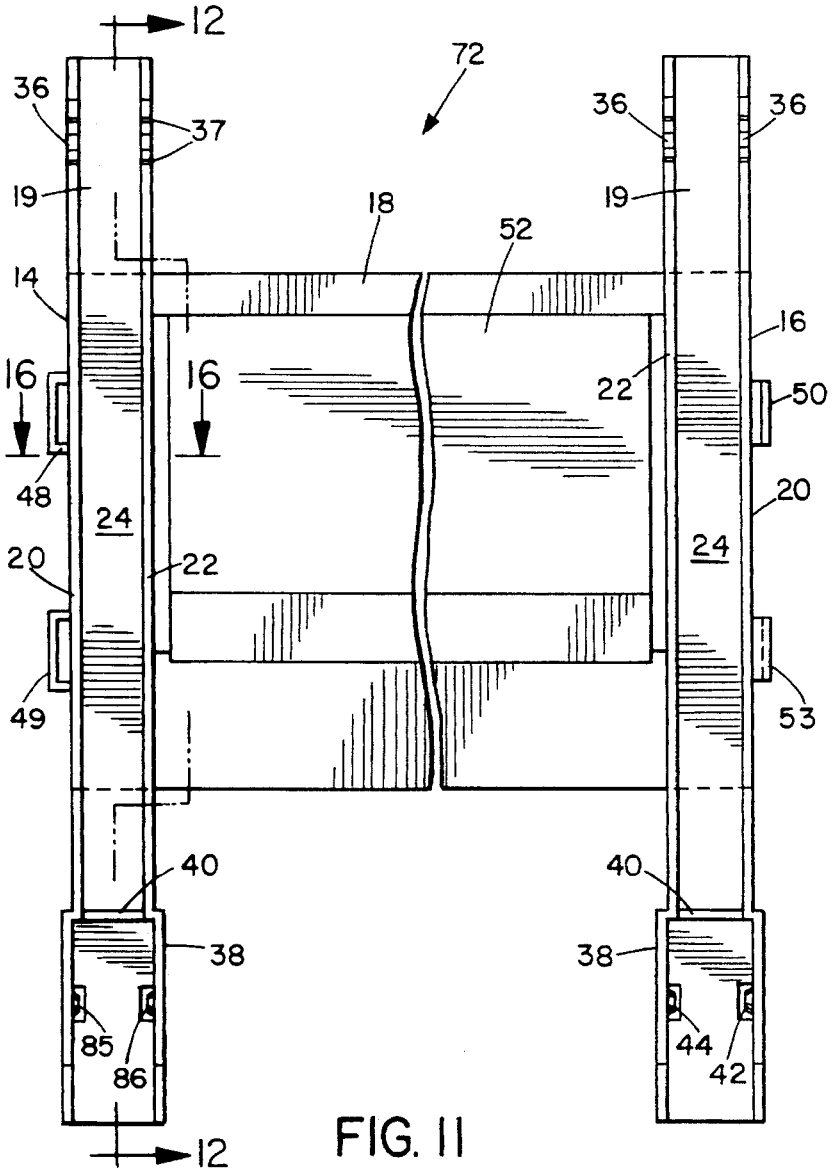
FIG. 11 is a view similar to FIG. 3, illustrating a modified panel unit according to a second embodiment of the invention.
Figure 12:
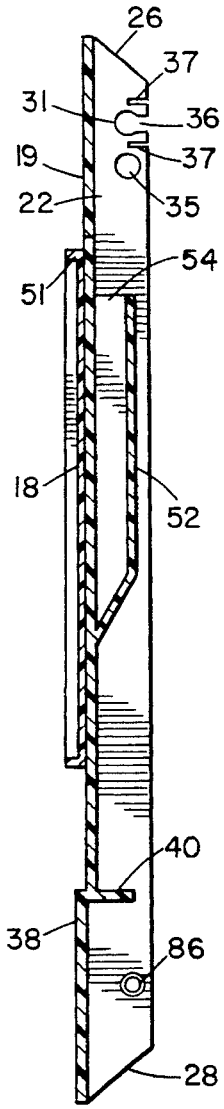
FIG. 12 is a sectional view taken on line 12—12 of FIG. 11.

FIGS. 11–16 illustrate a barricade assembly or structure of panel units 70 according to a second embodiment of the invention. Some parts of the units of FIGS. 11–16 are identical to parts in the first embodiment, and like reference numerals have been used for like parts, as appropriate. As best illustrated in FIGS. 11, 12 and 14, the barricade assembly 70 of this embodiment is also constructed from two or more identical panel units 72 which are hinged together at their uppermost ends to form an A-frame barrier. However, the hinge connection and vertical interconnection between the panel units is modified in this embodiment.

As illustrated in FIG. 11, each panel unit 72 has a pair of spaced, parallel side legs 14, 16 interconnected by a flat cross member or panel 18 extending between the legs. Each leg is of U-shaped or channel like cross-section, having a base wall 19 and upstanding side walls 20, 22 forming an elongate channel 24, as in the first embodiment.

Figure 13:
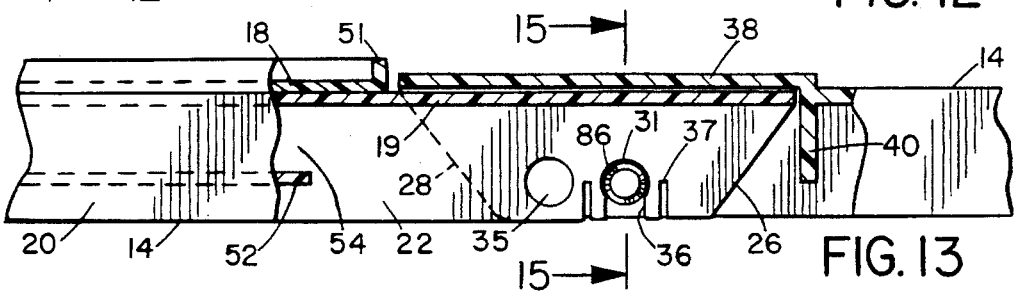
FIG. 13 is an enlarged sectional view similar to FIG. 7, illustrating the alternative end-to-end connection of two panel units.
Figure 15:
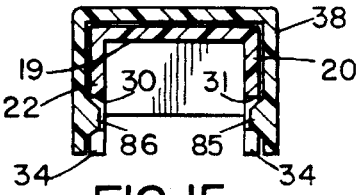
FIG. 15 is a sectional view taken on line 15—15 of FIG. 13.
Figure 16:
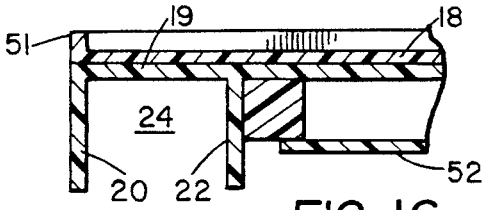
FIG. 16 is a sectional view on the lines 16—16 of FIG. 11.

As in the first embodiment, each leg 14, 16 has an enlarged channel portion 38 at its lower end which is dimensioned for mating engagement with the upper end portion of the channel of a corresponding leg of another panel unit. Small protuberances 85, 86 are provided on the inner faces of the side walls 20 and 22 for engagement in openings 30, 31 at the upper end of the corresponding legs of a second panel unit inserted into the enlarged portion 38, as illustrated in FIGS. 13 and 15.

As in the first embodiment, the panel units 72 can be hinged together in pairs to form an A-frame barricade, and two or more panel units can be stacked vertically as desired to adjust the vertical height of the barricade. Additionally, pairs of hinged panel units can be arranged side by side and linked together via hooks 50, 53 and eyelets 48, 49 to adjust the length of the barricade, as in the first embodiment. Also as in the first embodiment, the cross member 18 has an outer tray with a raised rim 51 for receiving suitable reflective signs or markings, and an upwardly facing rear compartment 52 with an open upper end 54 for receiving ballast material such as sand, for added stability. Again, the units are designed to snap or break apart relatively easily on impact, reducing the risk of damage to an impacting vehicle.

The side walls 20, 22 of each leg 14, 16 have a first pair of aligned holes 30, 31 at their upper ends, and a second pair of aligned holes 32, 35 spaced slightly below the first pair, as best illustrated in FIGS. 4 and 14. The first pair of holes 30, 31 each open into the side edges of the side walls 20, 22 via access openings 36 and slits 37 are provided on each side of each of the holes 30 and 31. The openings 34 leading into holes 30 allow the pivot pin 56 to snap out of the holes 30 on impact, with the slits 36 providing resilience at the sides of openings 34 allowing the pin 56 to be forced out of the holes more easily. A lock pin 58 may be inserted through the second pair of aligned openings 35 in the opposite side walls 20 of leg 14, so as to resist collapse of the legs from the open position illustrated in FIG. 14, or through the openings 32 in the opposite side walls of the other leg 16.

The panel units 72 of the second embodiment are preferably molded from a suitable lightweight, shock resistant plastic material such as polyethylene. The three basic parts 14, 16 and 18 are each molded separately and secured together in a conventional manner to form the finished panel unit 72.

The panel units for forming barricades as described above are durable, lightweight, and relatively inexpensive to manufacture and repair. Their light weight makes them easy to transport and assemble, while ballast material can be added as necessary for increased stability.

Figure 19:
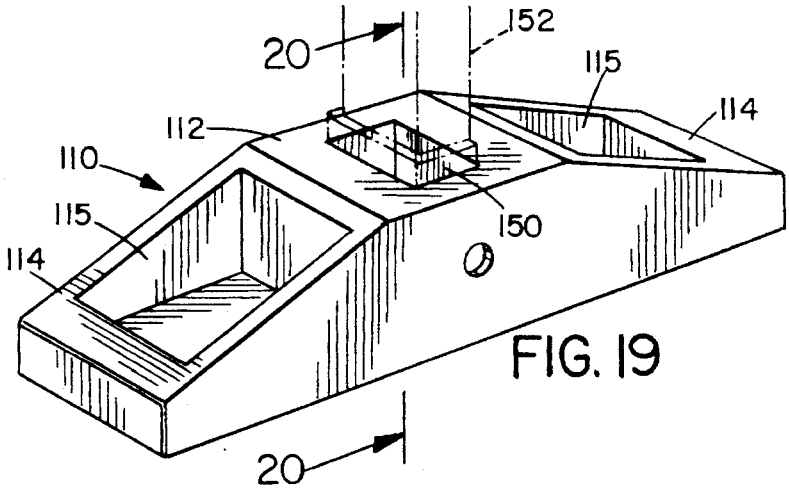
FIG. 19 is a perspective view of one form of a support foot for the unit.
Figure 21:
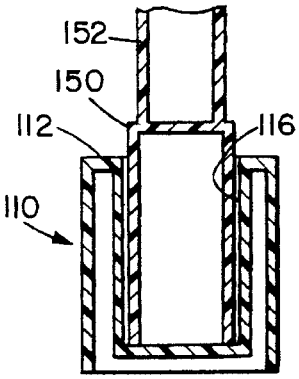
FIG. 21 is a sectional view similar to FIG. 20 without the retaining elements.
Figure 20:
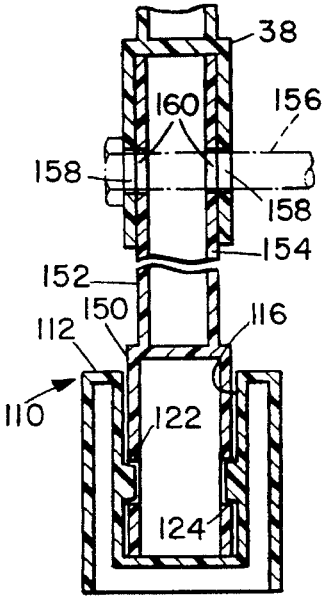
FIG. 20 is a sectional view taken on line 20—20 of FIG. 19.

FIGS. 19–23 illustrate various alternative versions of a foot for use in standing a single panel unit or two or more vertically stacked panel units in a vertical orientation. FIGS. 19–21 illustrate a first embodiment of a foot 110 which is of generally rectangular shape with a flat upper portion 112 and tapering sides 114 in which recesses 115 are located. The foot may be hollow or of solid construction, and may be made of any suitable material such as plastic. A central recess 116 is shaped and dimensioned to receive the enlarged end 150 of an extension post 152. The upper end 154 of the extension post is of shape and dimensions matching those of the top of a leg, so that it can be inserted into the lower end 38 of a panel unit leg, as illustrated in FIG. 20. Recess 116 may have opposing protrusions for engagement in corresponding holes 122, 124 provided in the opposite side walls of the enlarged end 150 of each post 152. However, in the preferred version, the end 150 is simply a close sliding fit in recess 116, as illustrated in FIG. 21.

Two feet 110 and extension posts 152 may be used for receiving the ends 38 of both legs 14 and 16 of a panel unit so that a single panel unit may be stood vertically at an appropriate height instead of being hinged to a second panel unit. Additional panel units may be secured to the vertically supported panel unit in a vertically stacked arrangement, if desired, to increase the height and the available sign receiving area. Two panel units on posts 152 may be secured together side-to-side via bolts 156 extending through suitable aligned holes 158, 160 provided in the side walls of the lower ends 38 of each leg and the upper end 154 of each post. Suitable ballast material may be poured into recesses 115 to increase stability, if necessary, as well as into the ballast compartment of the supported panel unit.

Figure 22:
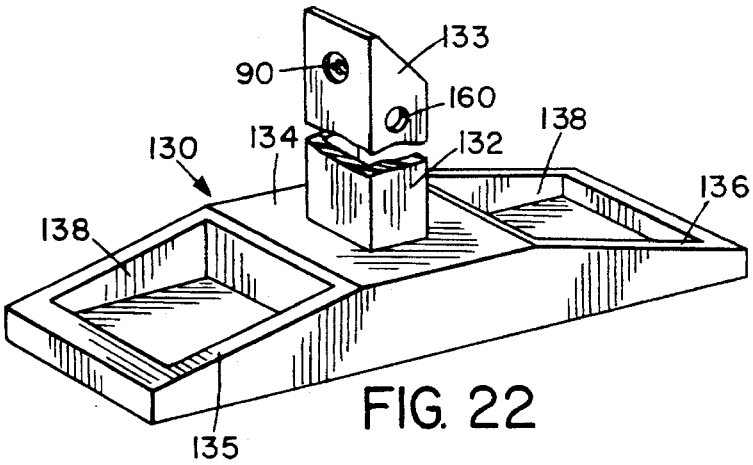
FIG. 22 is a perspective view of an alternative foot configuration.

FIG. 22 illustrates an alternative embodiment in which a foot 130 has an upstanding post 132 projecting upwardly from upper portion 134, and tapering sides 135, 136 in which recesses 138 for receiving ballast material are located. The upper end 133 of post 132 is of shape and dimensions matching those of the top of a leg, so that it can be inserted into the lower end 38 of a panel unit leg. The end 38 can be secured to boss 132 via latch pin 88 extending through key opening 90 as in the first embodiment of the invention described above. Bolt holes 160 are provided in the side walls as in the previous embodiment.

Figure 23:
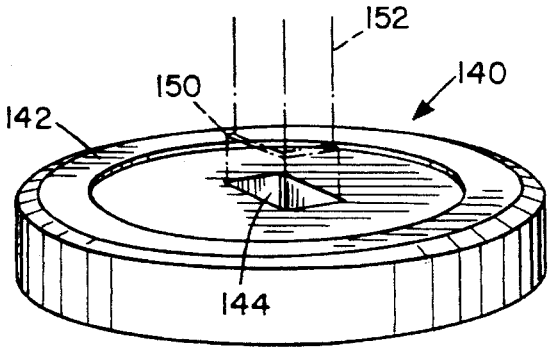
FIG. 23 is a perspective view of a further type of support foot.

FIG. 23 illustrates yet another alternative foot or stand 140 comprising a circular base 142 with a central recess 144 shaped and dimensioned for receiving the enlarged lower end 150 of an extension post 152 as in FIGS. 19–21. Base 142 may alternatively have an upstanding post identical to post 132 of FIG. 22 for supporting a leg. Stand 140 can be made inexpensively from old vehicle tires with their centers filled with cement and the appropriate recess or boss formed at the center of the cement filling.

Figure 27:
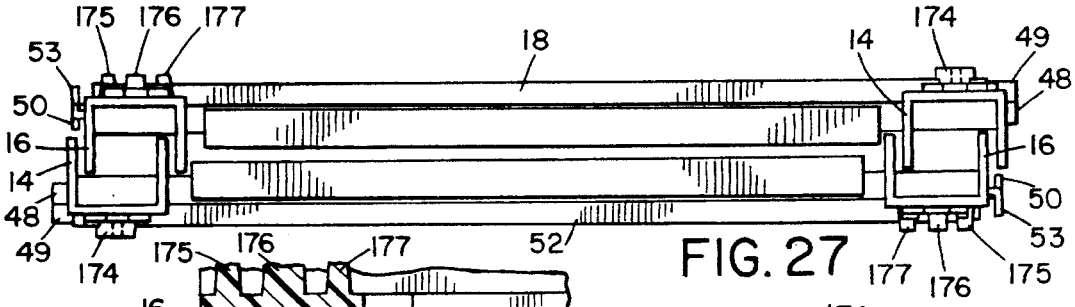
FIG. 27 is an end elevation view of a collapsed barrier unit as viewed from the bottom of FIG. 3.
Figure 28:
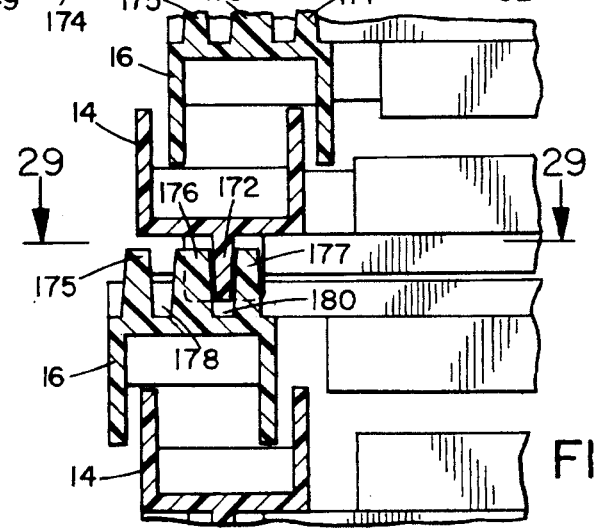
FIG. 28 is an enlarged sectional view taken in the location of line 28—28 in FIG. 25, and showing the interfitting of two collapsed barrier units.

The panel members of this invention are designed to be stackable in a stable fashion when not in use, as illustrated in FIGS. 27 and 28. A pair of hinged panel members can be collapsed together with their inner faces in face to face engagement as illustrated in FIG. 27. In view of the channel section shape of the opposing legs, the channels can be interleaved or meshed so that one side wall of a first leg extends into the channel of the opposing leg while the opposite side wall of the channel of the opposing leg extends into the channel of the first leg. In order to interleave the channels in this way, one of the panel members must be offset either to the right or left of the other panel member. In FIG. 27, the uppermost panel member is offset to the right of the underlying panel member, although it may alternatively be offset to the left until the other side wall can engage in the channel of the underlying leg. Pairs of panel members will already be interleaved in this way if hinged together at their upper ends as illustrated in FIGS. 1 and 2, and can simply be collapsed flat in this case. If separate, they can simply be offset and then placed face-to-face as in FIG. 27.

Figure 26:
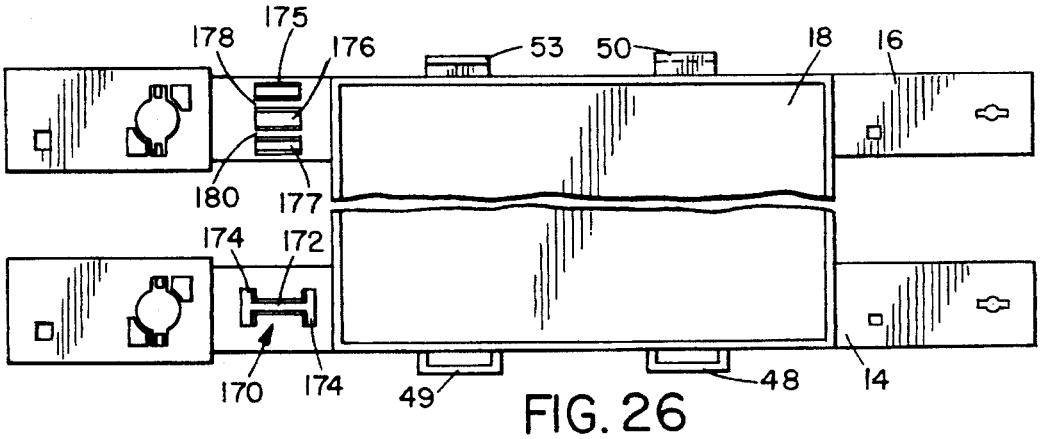
FIG. 26 is a top plan view of the structure of FIG. 24.

Thus, in order to stack panel members for storage or transportation from site to site, the panel members are first collapsed flat in pairs as in FIG. 27. Each panel member has an interfitting structure on the outer or front faces of its side legs for interfitting with a corresponding structure on another panel for stacking purposes. The interfitting structure comprises an I-shaped projection 170 on one of the legs 14, having a central straight portion 172 and a pair of transverse end portions 174, and three parallel straight bars or projections 175, 176 and 177 on the other leg 16, with a gap 178, 180 between each adjacent pair of projections 175,176 and 176, 177 respectively. The width and length of each gap 178, 180 corresponds to the width and length of the straight portion 172 of the I-shaped projection. The two gaps 178, 180 are offset to the left and right, respectively, of the center line of leg 16, as best illustrated in FIG. 26.

Figure 29:
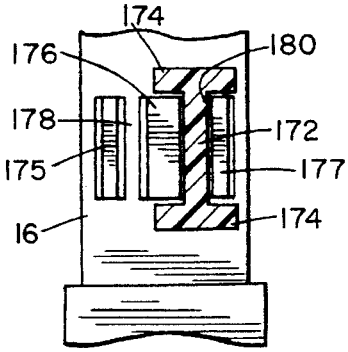
FIG. 29 is a sectional view taken on the line 29—29 of FIG. 28.

When one panel member is placed with its outer face facing the outer face of a second panel member, the I-shaped projection 170 on the leg 14 of the first panel member will face the projections 175, 176, 177 on the leg 16 of the second panel member, while the I-shaped projection 170 on the leg 14 of the second panel member faces the projections 175, 176, 177 on the leg 16 of the first panel member. If the first panel member is offset to the right of the center line of the second panel member, projection 170 will engage in the gap 180 between projections 176 and 177, as illustrated in FIG. 28, while the projection 170 on the leg 14 of the second, or underlying panel member, will engage in the gap 178 of the uppermost panel member. This will be reversed if the first panel member is offset to the left. This arrangement allows panel members which have first been stacked in pairs as in FIG. 27 to be stacked on top of each other regardless of the offset from one pair to the next. The interfitting I-shaped projection and parallel straight projections 175, 176, 177 will prevent the stacked members from wobbling either from side-to-side or front-to-back, since the ends 174 of projection 170 will engage over the ends of projections 175, 176 or 176,177, as illustrated in FIG. 29.

Figure 24:
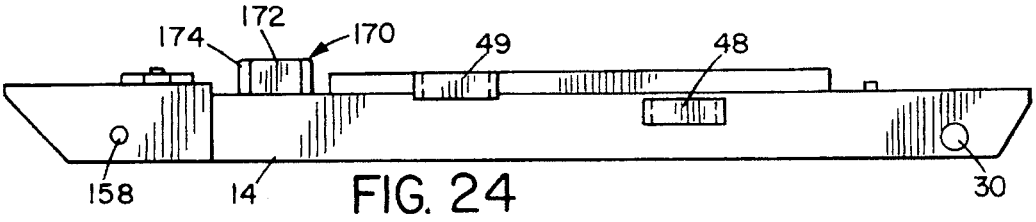
FIG. 24 is a side elevation view as taken from the left hand side of FIG. 3.
Figure 25:
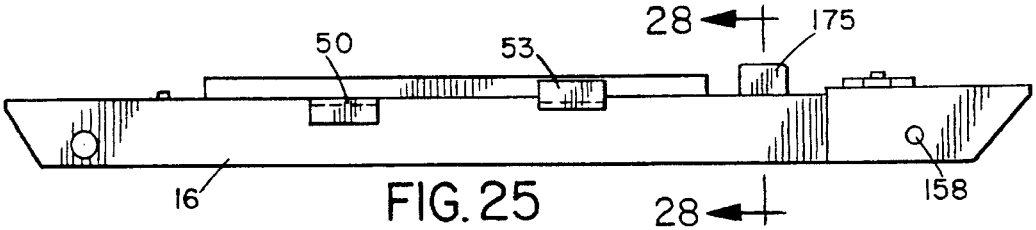
FIG. 25 is a side elevation view from the right hand side of FIG. 3.

In view of the interfitting engagement of the projections 170 and 175, 176, 177, they do not have to project out a significant amount from the surface of the leg 14 or 16, as can be seen in FIGS. 24 and 25. This means that they will be less likely to catch on things and potentially break off.

The barricade assembly of this invention is versatile and can be used in a number of possible alternative configurations, including pivoting two panel units together on each side of an A-frame-like stand, stacking two or more panel units vertically to increase the height of the pivoted stand, or standing one or more panel units vertically in feet or base stands provided for that purpose.

Although some preferred embodiments of the present invention have been described above by way of example only, it will be understood by those skilled in the field that modifications may be made to the disclosed embodiments without departing from the scope of the present invention, which is defined by the appended claims.

I claim:

1. A barricade assembly, comprising:

a plurality of panel units each having an outer face and an inner face, each panel unit comprising spaced, parallel first and second legs and a planar cross member extending transversely between the legs and oriented coplanar with both legs, the legs of each panel unit having upper and lower end portions, and the panel units being selectively securable together in a plurality of different configurations, each configuration including at least a first panel unit and a second panel unit;

a releasable hinge means for releasably hinging the upper end portions of the first panel unit directly to the upper end portions of the legs of the second panel unit, the inner faces of the first and second panel units facing one another in every possible configuration of the panel units, the first and second hinged panel units being pivotable about the hinge means between a collapsed position and an open, freestanding position in which the first and second panel units are at an angle to one another, the configurations including a first configuration comprising said first and second panel units, but not additional of said panel units, said first configuration forming a first hinged stand of a first height;

each panel unit having a first interlocking formation at the upper end portion of each leg and a second interlocking formation at the lower end portion of each leg, each second interlocking formation dimensioned and configured for releasable securing engagement with the first interlocking formation at the upper end of the legs of another of said panel units; and the configurations further including a second configuration in which said first and second panel units are hinged together and form an upper part of a second hinged, V-shaped stand, one side of the second stand comprising said first panel unit and a third panel unit, the second interlocking formations at the lower end portions of each leg of the first panel unit being releasably secured to the respective first interlocking formations at the upper end portions of each leg of the third panel unit with the first legs of the first and third panel units extending coaxially and the second legs of the first and third panel units extending coaxially, and the other side of said second stand comprising said second panel unit and a fourth panel unit, the second interlocking formations at the lower end portions of each leg of the second panel unit being releasably secured to the respective first interlocking formations at the upper end portions of each leg of the fourth panel unit with the first legs of the second and fourth panel units extending coaxially and the second legs of the second and fourth panel units extending coaxially, the second stand having a height greater than the first height, said configurations further including additional configurations wherein additional of said panel units are securable to the third and fourth panel units to selectively adjust the height of the assembly.

2. The assembly as claimed in claim 1, wherein each leg of each panel unit is of open channel cross-section having a base wall and upstanding side walls, with the open side of the channel being located on the inner face of the panel unit.

3. The assembly as claimed in claim 2, wherein the side walls of each leg of each panel unit have aligned openings in said upper end portions, and said hinge mechanism comprises a pivot pin for releasable insertion through the aligned openings in the upper end portions of the legs of said first and second hinged panel units in said open, free-standing position.

4. The assembly as claimed in claim 1, including stop means for limiting the maximum pivot angle between said first and second hinged panel units.

5. The assembly as claimed in claim 4, wherein the legs of each panel unit comprise channel members having open inner faces, the channel members at the upper end portion of the legs of said first and second panel units being in mating engagement in said open, freestanding position, and said channel members of said first and second panel units having angled upper end edges comprising said stop means.

6. The assembly as claimed in claim 1, including locking means for releasably locking said first and second panel units against collapse in said open, free-standing position.

7. The assembly as claimed in claim 6, wherein said locking means comprises first and second lever arms pivotally secured to said first leg of each of said first and second panel units, respectively, for movement between an inoperative position in which said lever arms are secured against said first legs and an operative position in which a free end of each lever arm bears against the opposing second leg of the other of said first and second panel units to resist collapse of said panel units from said open, free-standing position.

8. The assembly as claimed in claim 7, wherein said locking means comprises first and second notches within said second leg of each of said first and second panel units, respectively, for receiving the free end of the opposing lever arm in said operative position.

9. The assembly as claimed in claim 8, wherein each said lever arm has roller means at its free end for rolling engagement in the respective, opposing notch.

10. The assembly as claimed in claim 7, wherein said first lever arm has a first transversely projecting latch finger, and said second lever arm has a second transversely projecting latch finger, said first leg of said first panel unit having a first opening in alignment with said first latch finger of said first lever arm for releasably retaining said first lever arm in said inoperative position, said first leg of said second panel unit having a second opening in alignment with said second latch finger of said second lever arm for releasably retaining said second lever arm in said inoperative position.

11. The assembly as claimed in claim 1, wherein said cross member of each panel unit has a compartment for receiving ballast material, said compartment having an open upper end for freely pouring material into and out of the compartment.

12. The assembly as claimed in claim 1, wherein each leg of each panel unit is of open channel cross-section and the lower end portion of each leg of said first and second panel units is enlarged for telescopically receiving the upper end portion of the corresponding leg of said third and fourth panel units in said vertically aligned arrangement.

13. The assembly as claimed in claim 12, wherein the channel cross-section has a base wall and spaced side walls, and the side walls have opposing, inwardly directed bosses in said lower end portion, the side walls at the upper end portion of each leg of said third and fourth panel units having openings for receiving the bosses when the upper end portion of said legs of said third and fourth panel units is inserted in the lower end portion of the corresponding legs of said first and second panel units.

14. The assembly as claimed in claim 12, further including releasable locking means for releasably locking the upper ends of the legs of said third and fourth panel units to the lower ends of the legs of said first and second panel units respectively, in the vertically aligned, co-planar arrangement.

15. The assembly as claimed in claim 14, wherein the upper end portion of each leg of said third and fourth panel units has a first lock opening and the lower end portion of each leg of said first and second panel units has a corresponding lock opening for alignment with said first lock opening of the corresponding leg of said third and fourth panel units, respectively, said lock means comprises a twist lock pin having an enlarged head and shaft means for insertion through said aligned lock openings, and retaining means at the end of said shaft for releasably locking said end portions together.

16. The assembly as claimed in claim 1, wherein the first leg of each panel unit has an outer side face with a first latch mechanism, and the second leg of each panel unit has an outer side face with a second latch mechanism, the first latch mechanism of each panel unit comprising means for releasable latching engagement with the second latching mechanism of another on said panel units to secure the respective panel units together laterally, whereby two or more pairs of said panel units can be secured together side-by-side to selectively adjust the length of a barricade.

17. The assembly as claimed in claim 16, wherein the first latch mechanism of each leg of said panel units comprises a hook and the second latch mechanism of each leg of said panel units comprises an eye member for selectively receiving one of said hooks on another of said panel units.

18. The assembly as claimed in claim 1, wherein the first leg of each panel unit has an outer side face with a first latch mechanism, and the second leg of each panel unit has an outer side face with a second latch mechanism, the first latch mechanism of each panel unit comprising means for releasable latching engagement with the second latching mechanism of another of said panel units to secure the respective panel units together in a side-by-side, co-planar arrangement, whereby two or more pairs of pivoted first and second panel units can be secured together side-by-side to selectively adjust the length of a barricade.

19. The assembly as claimed in claims 18, wherein the first latch mechanism comprises at least one hook and the second latch mechanism comprises at least one eye member for selectively receiving a at least one of said hooks on another of said panel units.

20. The assembly as claimed in claim 19, wherein the first latch mechanism comprises a pair of vertically spaced, oppositely directed hook members oriented to face horizontally outwardly from said panel unit, and the second latch mechanism comprises a pair of vertically spaced, horizontally oriented eye members for selectively receiving said hook members.

21. The assembly as claimed in claim 1, wherein the first leg of each panel unit has a first interfitting formation projecting outwardly from its outer face and the second leg of each panel unit has a second interfitting formation projecting outwardly from its outer face, the first interfitting formation comprising means for interfitting engagement with a second interfitting formation on the second leg of another of said panel units when the panel units are stacked one on top of the other with their outer faces in face-to-face engagement.

22. The assembly as claimed in claim 21, wherein the first interfitting formation comprises an I-shaped member, having a central straight portion and a pair of transverse end members, and the second interfitting formation comprises at least two spaced, parallel straight bars with a space between the bars for receiving the straight portion of the I-shaped member with the transverse members fitting projecting across the opposite ends of the bars.

23. The assembly as claimed in claim 22, wherein the second interfitting formation comprises three parallel straight bars forming first and second spaces offset on opposite sides of the center line of the leg for selectively receiving the straight portion of the I-shaped member of an opposing leg.

* * * * *